United States Patent [19]

Chang

[11] 4,452,667

[45] Jun. 5, 1984

[54] LABELLING MACHINE

[76] Inventor: Sang B. Chang, 268-3, Suyu 2-dong, Dobon-Ku, Seoul, Rep. of Korea

[21] Appl. No.: 396,928

[22] Filed: Jul. 9, 1982

[30] Foreign Application Priority Data

Jul. 29, 1981 [KR] Rep. of Korea ..... 2748
Jul. 29, 1981 [KR] Rep. of Korea ..... 2749

[51] Int. Cl.[3] ..... B65C 11/02

[52] U.S. Cl. ..... 156/384; 101/288; 156/577; 156/579; 156/584; 156/DIG. 49

[58] Field of Search ..... 156/384, 574, 577, 579, 156/584, 541, DIG. 33, DIG. 48, DIG. 49; 101/288

[56] References Cited

U.S. PATENT DOCUMENTS

| | | | |
|---|---|---|---|
| 2,326,436 | 8/1943 | Caldwell | 156/384 |
| 3,231,446 | 1/1966 | Satas | 156/584 |
| 3,265,553 | 8/1966 | Kind et al. | 156/584 |
| 3,674,609 | 7/1972 | Schrotz et al. | 156/577 |
| 4,026,758 | 5/1977 | Sato | 156/579 |
| 4,233,900 | 11/1980 | Sato | 101/288 |
| 4,369,085 | 1/1983 | Hermann | 156/384 |

*Primary Examiner*—Michael G. Wityshyn
*Attorney, Agent, or Firm*—Jones, Tullar & Cooper

[57] ABSTRACT

A labelling machine including a feed roller and a guide member in the form of a tunnel guide member which guides the tape from the roll over the feed roller. The guide member is movable away from the feed roller when the labelling machine is opened to facilitate insertion of the label tape.

6 Claims, 6 Drawing Figures

LABELLING MACHINE

This invention relates to labelling machines.

Conventional labelling machines are generally inconvenient because, firstly, the path of the label tape from its entry to the printing pad is not straight, secondly, the label tape is disturbed at various points along its path, and, thirdly, it is difficult to insert the label tape into the machine as it is not stiff.

Label tape often has small round or long holes spaced along its middle and the conventional labelling machine is equipped with a feed roller with protrusions formed around its centre to be inserted into the holes in the tape in order that the feed roller, when it is rotated, will drive the tape.

Consequently, the holes in the middle of the label tape reduce the printable space in the label tape and are also ugly. Accordingly, it is usual for the holes in the label tape to be formed in as small a size as possible as close to the size of the protrusions of the feed roller. Sometimes, therefore, the protrusions on the feed roller are not inserted properly into the holes in the label tape, causing the label tape to be torn and the feed not to be achieved smoothly.

The present invention provides a labelling machine including a feed roller, a guide member being provided movable towards and away from the feed roller so that when moved towards the feed roller the feed roller may transfer label tape and a print means to print on the label tape.

Figure 1:
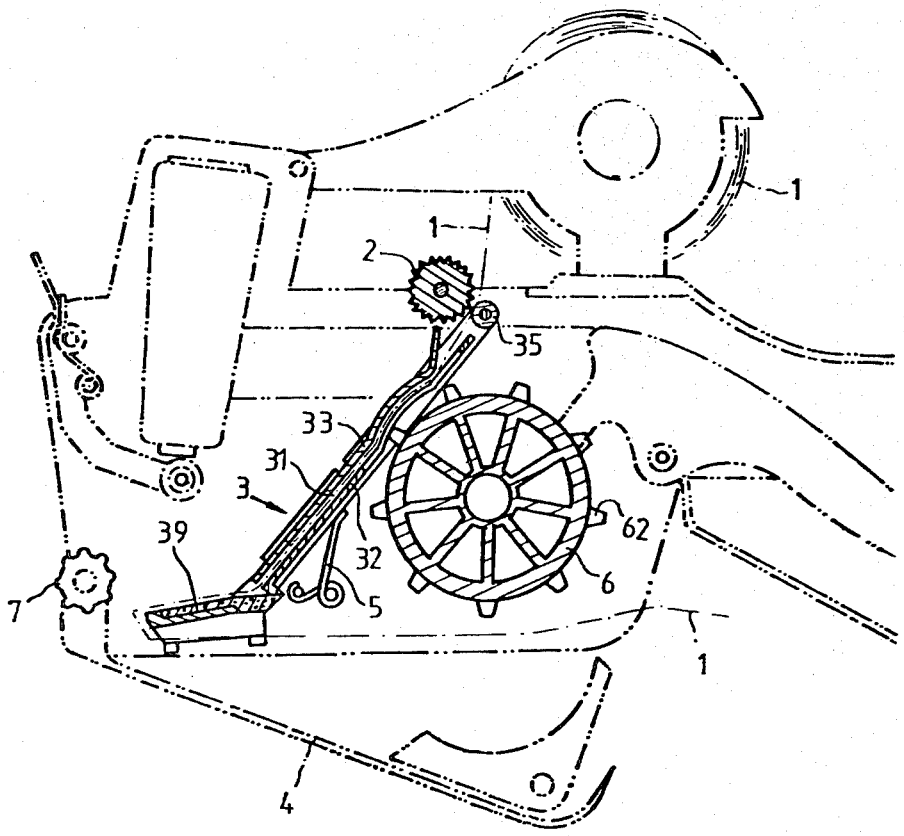
Figure 2:
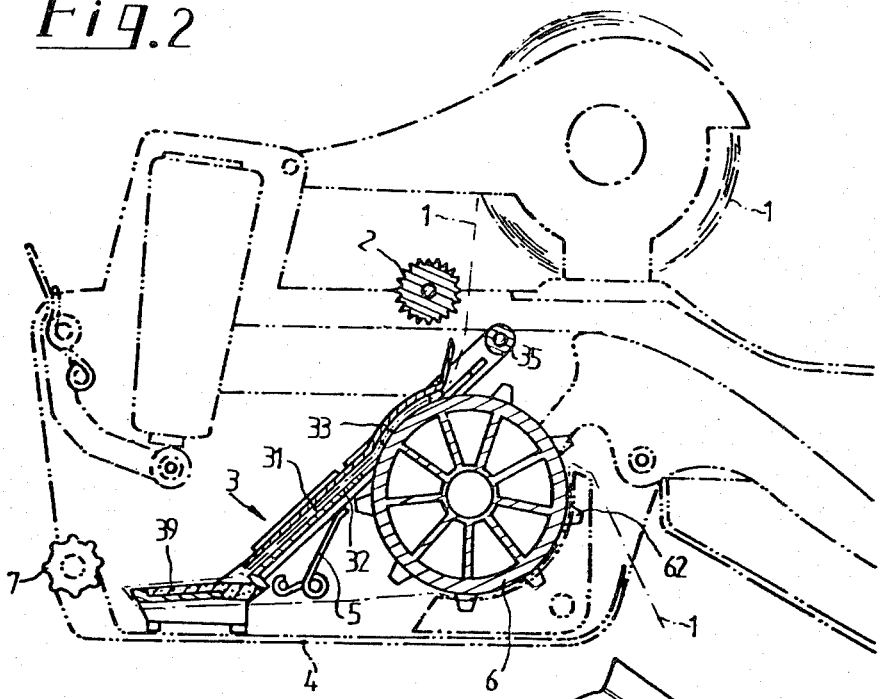
Figure 3:
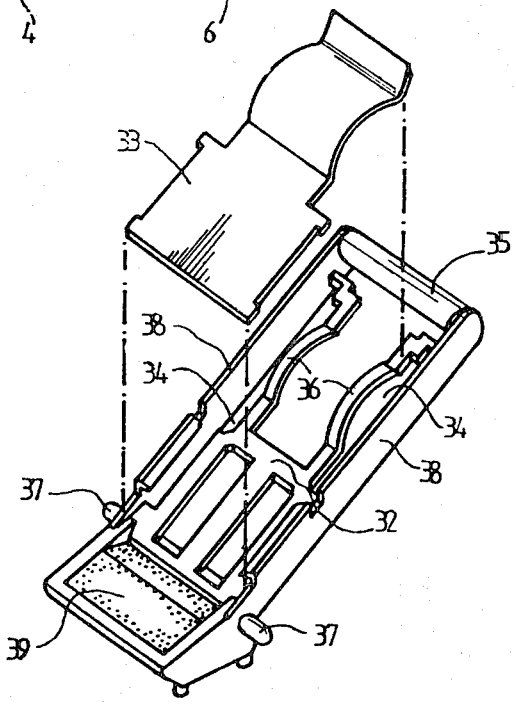
Figure 4:
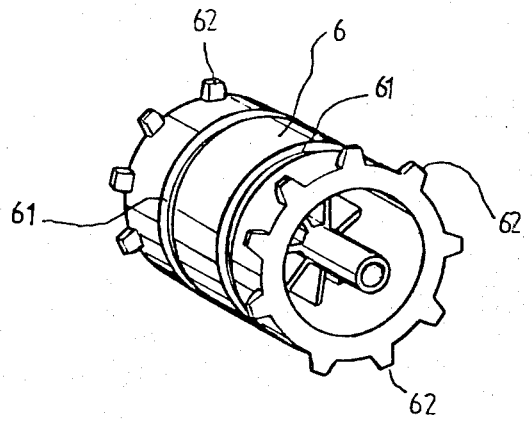
Figure 5:
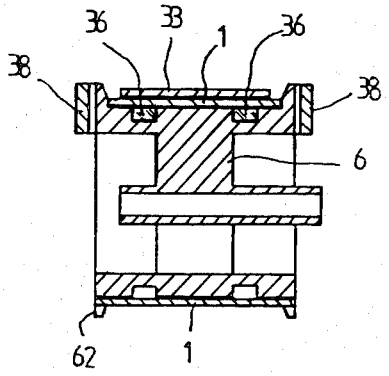
Figure 6:
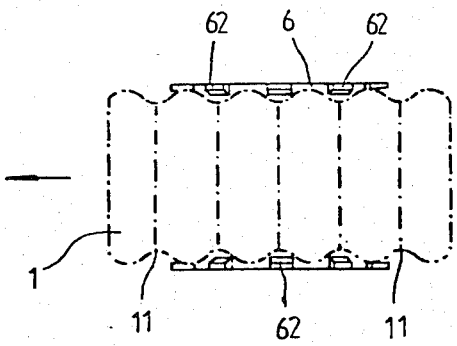

A machine according to a preferred embodiment of the invention will now be described by way of example according to the drawings attached hereto in which:

FIG. 1 is a cross sectional view of the machine in the open position showing how the label tape can be inserted, FIG. 2 is a cross sectional view similar to FIG. 1 of the machine when closed, FIG. 3 is a perspective, exploded view of part of the machine of FIGS. 1 or 2, FIG. 4 is a perspective view of a feed roller of the machine, FIG. 5 is an axial section of the feed roller of FIG. 4 over which label tape is passing, and FIG. 6 shows the manner in which the feeds roller feeds the label tape.

As illustrated in the FIGS. 1 and 2, a roll 1 of label tape is mounted on the labelling machine and label tape from the roll passes through a guide tunnel member 3 which guides the label tape over a feed roller 6 and over a printing pad 39. In order to insert the roll of tape in the machine, the machine is opened as shown in FIG. 1. When the machine is opened by pivotting open a bottom cover 4, a spring 5 moves tunnel member 3 counterclockwise away from the feed roller 6, and a guide roller 35 mounted on the upper end of tunnel guide member 3 is brought into contact with a hand rotated roller 2. Accordingly, when an end of label tape 1 is inserted between the roller 35 and the hand-operated roller 2, the label tape 1 is passed through tape tunnel 31 by rollers 35 and 2 with the underside of the label facing upward and comes out from between printing pad 39 at the lower end of tunnel member 3 and a press roll 7. The end of the label tape 1 which comes out from between printing pad 39 and press roll 7 is then engaged with the lower side of feed roller 6 and then the bottom cover 4 is closed.

When the bottom cover 4 is closed, it pushes up the lower end of tunnel guide member 3 and hence rotates it clockwise, bringing the upper part thereof into contact with the upper side of the feed roller 6 as shown in FIG. 2. The tunnel member 3 ensures engagement of the label tape 1 with the feed roller 6.

As illustrated in FIG. 4, the feed roller 6 has grooves 61 formed on its circumference and protrusions or teeth 62 regularly circumferentially spaced at its axially opposite ends. The spacing between the adjacent teeth 62 must be equal to the length of an individual label and a notch 11 is formed at both sides of the label. As illustrated in FIG. 6, therefore, each tooth 62 on the feed roller 6 is engaged with a notch 11 so that the label tape 1 may be fed when feed roller 6 rotates.

The tunnel member 3 includes an axle 37 about which it may pivot between two positions in which its upper end contacts with the feed roller 6 or is spaced therefrom as already described as the cover 4 is closed or opened. The tunnel member 3 includes a guide tunnel 31 formed between a lower pad 32, a cover 33, and sidewalls 38. There is a long slot 34 provided on both sides of the upper end of lower pad 32 and also a large slot in the central part thereof. This leaves two rails 36 formed at the upper end of lower pad 32. In place of two rails 36 there may be provided one central rail or even more than two rails. However arranged, the rail 36 should be so provided as to form a tunnel 31 under the cover 33 to pass the label tape therebetween without disturbance. However, it is necessary to have a long slot 34 formed on both sides thereof. The central part of the rail 36 must be so curved upward as to engage in the groove 61 of the feed roll 6, as illustrated in FIG. 4. The upper surface of rail 36 inserted into the groove 61 should extend in a similar circumferential manner to the surface of feed roller 6 to form a generally smooth guiding surface and the teeth 62 on the transfer roller are inserted in the grooves 11 on both sides of label tape 1. Thus, the label tape 1 is driven forwards when the feed roller 6 is rotated. The upper part of the tunnel member 3 must of course be in contact with the feed roller 6 while the feed roller 6 is feeding label tape 1.

When the roll of label tape 1 is used up and requires replacement, the tunnel member must be pivotted away from the feed roller 6 in order that tunnel 31 may be open for insertion of a new roll of tape.

The tunnel member 3 pivots counterclockwise, as shown in FIG. 1, by the spring 5 so that the upper part of tunnel member 3 separates from the feed roller 6. New tape can then be inserted as already described.

The printing pad 39 is provided below the lower end of tunnel member 3 and is rigidly connected thereto. As illustrated in FIG. 2, when the bottom cover 4 is closed, it pushes up the bottom of printing pad 39 which pivots the tunnel member 3 clockwise. Thus, the upper part of tunnel member 3 comes into contact with feed roller 6 which then feeds label tape for imprinting thereon.

The tunnel member 3 facilitates replacement of the label tape. Label tape being fed is not torn because it is transferred by teeth 62 on both sides of feed roller 6. Also, teeth 62 cannot be inserted wrongly into the grooves 11 because the grooves 11 formed on both sides of label tape are wide enough.

I claim:

1. A labelling machine including:

a feed roller;

a guide member movable toward and away from the said feed roller;

means mounted on the upper end of said guide member and operable when said guide member is moved away from said feed roller to cause a label tape to be fed into said guide member;

guide means formed in said guide member to receive label tape and operable when said guide member is moved toward said feed roller to engage said feed roller, thereby to enable said feed roller to feed label tape; and print means to print on the label tape.

2. A labelling machine as claimed in claim 1, in which said guide means includes rails and said feed roller is provided with grooves with which said rails may engage.

3. A labelling machine as claimed in claim 1, in which said means mounted on the upper end of said guide member includes a guide roller and further including a hand operated roller mounted close thereto so that label tape inserted between said guide roller and said hand operated roller will pass into said guide means when the hand operated roller is rotated.

4. A labelling machine as claimed in any of claims 1 to 3 in which said guide member includes a spring so as to separate the guide member from said feed roller.

5. A labelling machine as claimed in any of claims 1 to 3 further including a printing pad attached to the lower end of said guide member, said printing pad being so located as to be pushed upwardly during closure of a bottom cover for said labelling machine in order to bring said guide means into contact with said feed roller.

6. A labelling machine as claimed in any of claims 1 to 3, further including sets of equally spaced teeth at axially opposite ends of said feed roller, said teeth being adapted to engaged corresponding curved notches on opposite sides of label tape for feeding the tape.

* * * * *